US005661363A

United States Patent [19]

Iguchi et al.

[11] Patent Number: 5,661,363

[45] Date of Patent: Aug. 26, 1997

[54] LUMINATED MAIN LENS MEMBER FOR AN ELECTRON GUN

[75] Inventors: Yukinobu Iguchi; Tsuneo Muchi, both of Kanagawa; Tsunenari Saito, Tokyo; Tomohisa Asano, Kanagawa, all of Japan

[73] Assignee: Sony Corporation, Tokyo, Japan

[21] Appl. No.: 501,373

[22] Filed: Jul. 12, 1995

[30] Foreign Application Priority Data

Jul. 13, 1994 [JP] Japan ..... 6-184088

[51] Int. Cl.[6] ..... H01J 29/58; H01J 29/56

[52] U.S. Cl. ..... 313/412; 313/414; 313/450

[58] Field of Search ..... 313/412, 444, 313/450, 449, 414, 460, 439, 425, 432

[56] References Cited

U.S. PATENT DOCUMENTS

| | | | |
|---|---|---|---|
| 2,533,790 | 12/1950 | Grivet | 313/444 |
| 4,608,515 | 8/1986 | Chen | 313/412 |
| 4,748,372 | 5/1988 | Noordermeer | 313/412 |
| 4,857,797 | 8/1989 | Vrijssen et al. | 313/450 |
| 4,961,023 | 10/1990 | Vrijssen et al. | 313/450 |
| 4,980,606 | 12/1990 | Yamauchi et al. | 313/450 |
| 4,988,929 | 1/1991 | Spanjer et al. | 313/450 |

*Primary Examiner*—Sandra L. O'Shea
*Assistant Examiner*—Jay M. Patidar
*Attorney, Agent, or Firm*—Hill, Steadman & Simpson

[57] ABSTRACT

A main lens member for an electron gun comprises at least one high electrical resistance layer formed of a higher electrical resistance material sandwiched between low electrical layers which are laminated together to form a main line of an electron gun.

16 Claims, 12 Drawing Sheets

LUMINATED MAIN LENS MEMBER FOR AN ELECTRON GUN

BACKGROUND OF THE INVENTION

1. Field of the Invention

The present invention relates to a main lens member for an electron gun provided in a cathode ray tube used for example for a color tube, projector tube, or index tube and to an electron gun using the same.

2. Description of the Related Art

An uni-potential focus type electron gun provided in a cathode ray tube is for example designed with a first grid to fifth grid arranged concentrically with respect to the tube axis as the accelerating and converging electrodes with respect to a cathode for emitting electrons. The electron beam emitted from the cathode is converged on the phosphor screen due to the action of a pre-focus lens system formed by the second and third grids and a main lens system formed by the third grid, fourth grid, and fifth grid. An anode voltage is applied to the third grid and fifth grid, while a voltage close to zero is applied to the fourth grid. These cathode and first to fifth grids are fixed in place by beading of beading glass to be assembled into a single unit. The first to fifth grids are for example made of stainless steel.

Such an electron gun as the related art is susceptible to deviation in the concentricity among the third to fifth grids forming the main lens system. Accordingly, it suffers from sometimes the disadvantage of an off-axis angle of the electron beam and consequent defocusing. Also, due to the step-like nature of the potential difference among the grids, it also suffers from the disadvantages that electric discharge easily occurs among the third to fifth grids and, further, the spherical aberration of the main lens system becomes greater and the beam spot becomes larger in diameter.

The assignee of this application filed a previous U.S. patent application for an electron gun solving the above disadvantages on Dec. 27, 1993 Ser. No. 08/172,733). The electron gun of this prior application, as explained with reference to the embodiment illustrated in FIG. 2 attached to the specification of that application, has a main lens consisting of a hollow high resistance tube 3 and ring-shaped electrode films 8, 9, and 10 formed on the inner surfaces of the two ends and the inner surface of the center portion of the high resistance tube 3. The electron beam passes inside the hollow high resistance tube 3. The ring-shaped electrode films 8, 9, and are made of a ruthenium oxide-glass paste and respectively performed the functions of the third grid $G_3$, fourth grid $G_4$, and fifth grid $G_5$. On the other hand, on the inner surface of the high resistance tube 3 between the electrode films 8, 9, and 10 there are formed a plurality of conductive rings 11 made of the same material as the electrode films 8, 9, and 10. The electrode films 8, 9, and 10 and the plurality of conductive rings 11 are formed in a direction perpendicular to the tube axis (Z-axis) of the high resistance tube 3.

Since the main lens of this earlier application is comprised of the hollow high resistance tube 3 and electrode films 8, 9, and 10, it is possible to design a large distance among the electrode films 8, 9, and 10, possible to made the potential gradient between the electrodes lower, and possible to reduce the spherical aberration and thereby reduce the size of the electron beam spot. Further, by providing the conductive rings 11, it is possible to make the surface potential at the inside of the high resistance tube 3 uniform (that is, possible to achieve rotational symmetry about the tube axis) and thereby increase the stability with respect to local changes in potential in the main lens system caused by stray emission ("charge up") etc.

Further, as explained with reference to another embodiment illustrated in FIG. 21 attached to the specification of the earlier application, the main lens could also have been comprised of two high resistance ceramic members 46 and a metal member 50 sandwiched between these ceramic members 46. The high resistance ceramic members 46 have the third grid $G_3$ and a fifth grid $G_5$ formed on them, while the metal member 50 corresponded to the fourth grid $G_4$.

In addition, as explained with reference to still another embodiment illustrated in FIGS. 22A and 22B attached to the specification of the earlier application, the main lens could have been comprised of superposed ring-shaped members 54 made of a high resistance ceramic between which were inserted disk-shaped metal plates 55.

In the fabrication of the main lens of the embodiment illustrated in FIG. 2 of the above earlier application, however, it is necessary to form the electrode films 8, 9, and 10 and the plurality of conductive rings 11 on the inner surface of the high resistance tube. The electrode films 8, 9, and 10 and the plurality of conductive rings 11 are formed by using a rubber roller to transfer the conductive paste to the inner surface of the high resistance tube, then trimming the conductive paste or combining a negative resist material and the metal thin film vapor deposition method or the metal mask vapor deposition method, heat transfer method, dispenser method, etc.

No matter what method was used, however, it is difficult to form the electrode films 8, 9, and 10 and the plurality of conductive rings 11 on the inside surface of the high resistance tube with a high precision. In particular, when making the inside diameter of the high resistance tube 3 smaller or in the case of an electron gun for a picture tube having a plurality of holes through which electron beams pass, it is even more difficult to form the electrode films 8, 9, and 10 and the plurality of conductive rings 11 with a high precision.

In the fabrication of the main lens of the embodiments illustrated in FIG. 21 and in FIGS. 22A and 22B of the above earlier application, it is difficult to join the ceramic members 46 and metal members 50 and to join the ring-shaped members 54 and metal plates 55 since they are completely different materials.

Also, in the above earlier application, there is the problem that it is difficult to join and hold the high resistance tube 3 or joined ceramic members 46 and metal members 50 or ring-shaped members 54 and metal plates 54 constituting the main lens to other components of the electron gun.

SUMMARY OF THE INVENTION

A first object of the present invention is to provide a main lens member for an electron gun, and such an electron gun, which is easy to fabricate yet can be fabricated at a high precision, which enables the deviation of the concentricity of the main lens system to be suppressed and the off-axis angle of the electron beam to be reduced, which enables prevention of electric discharge at the main lens member, which enables the potential gradient in the main lens member to be reduced, and further which enables the spherical aberration of the main lens system to be made smaller.

A second object of the present invention is to provide a main lens member for an electron gun, and such an electron gun, which in addition to the first object enables easy joining and holding with other components of the electron gun.

To achieve the first object, according to a first aspect of the present invention, there is provided a main lens member for an electron gun for converging an electron beam including at least one high electrical resistance layer made of a high electrical resistance material and at least one low electrical resistance layer made of a low electrical resistance material laminated together.

Preferably, the main lens member for an electron gun of the present invention is made of N number of high electrical resistance layers and (N+1) number of low electrical resistance layers laminated together. The number N is not particularly limited, but in practice is preferably 3 to 5. The high electrical resistance material and low electrical resistance material are preferably made of a ceramic as a main ingredient. In this case, resistance layers of the high electrical resistance material and resistance layers of the low electrical resistance material are preferably alternately laminated and simultaneously sintered to form a single unit. Alternatively, the high electrical resistance material is comprised of a ceramic as a main ingredient and the low electrical resistance material is comprised of a ruthenium oxide type material. In this case, the high electrical resistance material is preferably sintered to produce high electrical resistance layers, the low electrical resistance material is coated on the surfaces of the high electrical resistance layers, a plurality of the high electrical resistance layers are superposed, then the low electrical resistance material is sintered to form them into a single unit. Preferably, further, provision is made of metal members buried in the main lens member. Alternatively, the high electrical resistance layers or low electrical resistance layers may have protections for beading by beading glass.

To achieve the second object, according to a second aspect of the present invention, there is provided a main lens member for an electron gun wherein provision is made of mounting-use metal members at the two ends of the main lens member. In this case, the mounting-use metal members may be shrink-fit to the two ends of the main lens member. Further, the mounting-use metal members may have projections for attaching beading glass. Alternatively, the mounting-use metal members may have projections for affixment to insulating members having mounting holes.

According to a third aspect of the present invention, there is provided an electron gun with a main lens member comprised of at least one high electrical resistance layer made of a high electrical resistance material and at least one low electrical resistance layer made of a low electrical resistance material laminated together.

BRIEF DESCRIPTION OF THE DRAWINGS

These and other objects and features of the present invention will become apparent from the following description of preferred embodiments made with reference to the accompanying drawings, wherein.

DESCRIPTION OF THE PREFERRED EMBODIMENTS

The main lens member of the present invention is made of high electrical resistance layers and low electrical resistance layers laminated together. Accordingly, the main lens member of the present invention is easy to fabricate yet can be fabricated with a high precision. Therefore, it is possible to suppress deviation of the concentricity of the main lens member and reduce the off-axis angle of the electron beam.

By making the main lens member such a structure, it is possible to make the resistance of the main lens member as a whole from several tens of Giga ohm (GΩ) to several hundreds of Giga Ω. Due to this, it is possible to sufficiently suppress the heat generated at the main lens member at the time of operation of the electron gun and enable the electron gun to operate stably. On the other hand, the voltage drop at the low electrical resistance layers is smaller than the voltage drop at the high electrical resistance layers, so it is possible to deem substantially the same potential to exist in one low electrical resistance layer and to substantially ignore the variations in resistance of the low electrical resistance layers. Each high electrical resistance layer is sandwiched between low electrical resistance layers, so even if the resistance locally varies in the high electrical resistance layer, the current will flow parallel to the tube axis in the high electrical resistance layer. As a result, it is possible to form a distribution of potential with rotational symmetry about the tube axis. Further, even when the apparent resistance of a high electrical resistance layer locally changes due to stray emission etc. during the operation of the electron gun, since the high electrical resistance layer is sandwiched between low electrical resistance layers, there is almost no disturbance of the rotational symmetry of the potential about the tube axis. Further, it is possible to achieve the object of reducing the potential gradient of the inside of the main lens member by the high electrical resistance layers, preventing electric discharge in the main lens member, reducing the spherical aberration of the main lens system, and making the electron beam spot smaller.

Further, by providing the main lens member with mounting-use metal members or providing the high electrical resistance layers or low electrical resistance layers with projections, it is possible to easily assemble the main lens member in an electron gun.

The present invention will now be explained further using preferred embodiments of the present invention explained with reference to the drawings.

Figure 1A:
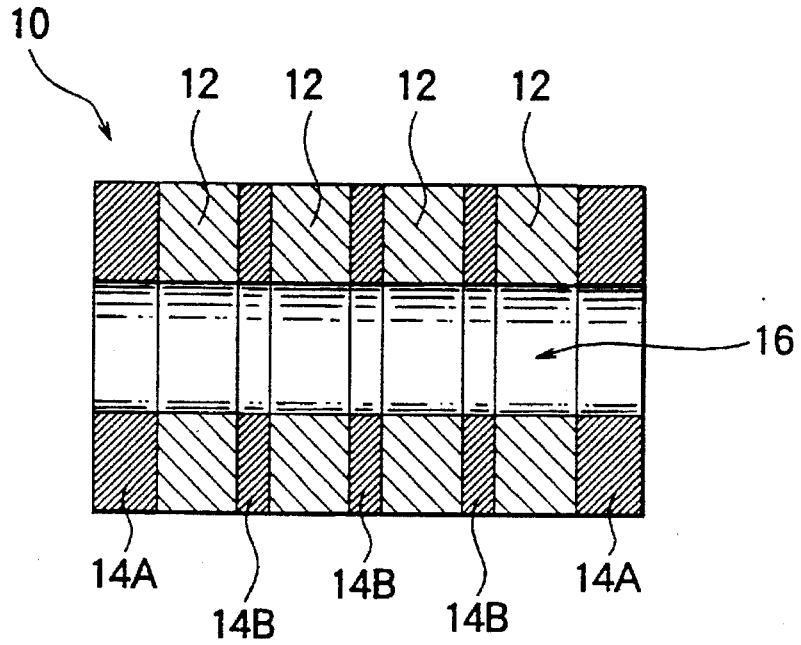
FIGS. 1A and 1B are a schematic view and a perspective view of a main lens member of a first embodiment.
Figure 1B:
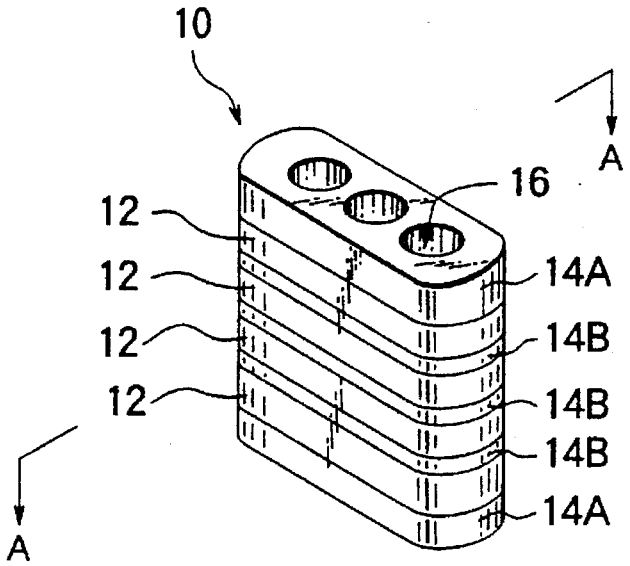

FIG. 1A is a schematic cross-sectional view of a main lens member 10 for converging an electron beam in an electron gun of a first embodiment. FIG. 1B is a view of the main lens member 10 seen from an angle. The main lens member 10 of the first embodiment is suitable for use in a main lens system of a bi-potential focus system and is one used for an in-line gun configuration. FIG. 1A is a cross-sectional view taken along line A—A of FIG. 1B.

The main lens member 10 of the first embodiment is comprised of high electrical resistance layers 12 made of a high electrical resistance material and low electrical resistance layers 14A and 14B made of a low electrical resistance material laminated together. More specifically, it is comprised of four (N=4) high electrical resistance layers 12 and five (N+1=5) low electrical resistance layers 14A and 14B alternately laminated to form a single unit. The high electrical resistance material and the low electrical resistance material are comprised of an $Al_2O_3$ type ceramic as a main ingredient. By changing the type and/or percent addition of a metal or other conductive material added to the ceramic, it is possible to change the resistance. The volume resistivity of the high electrical resistance layers 12 is preferably $10^{10}$ to $10^{12}\Omega$.cm. On the other hand, the volume resistivity of the low electrical resistance layers 14A and 14B is preferably lower than the volume resistivity of the high electrical resistance layers 12, for example, is less than $10^{10}\Omega$.cm. Further, the difference of the volume resistivity of the high electrical resistance layers 12 and the volume resistivity of the low electrical resistance layers 14A and 14B is preferably at least a double-digit difference. In the figures, reference numeral 16 indicates a beam passage hole through which an electron beam passes.

As an example, a focus voltage, for example, 5 to 10 kV, is applied to one end of a low electrical resistance layer 14A, while an anode voltage, for example, 20 to 30 kV, is applied to the other end of the low electrical resistance layer 14A. By passing a predetermined current through the main lens member between them, a potential gradient is caused and it is possible to cause the generation of an electrical field with a small spherical aberration in the beam passage holes 16.

Figure 2:
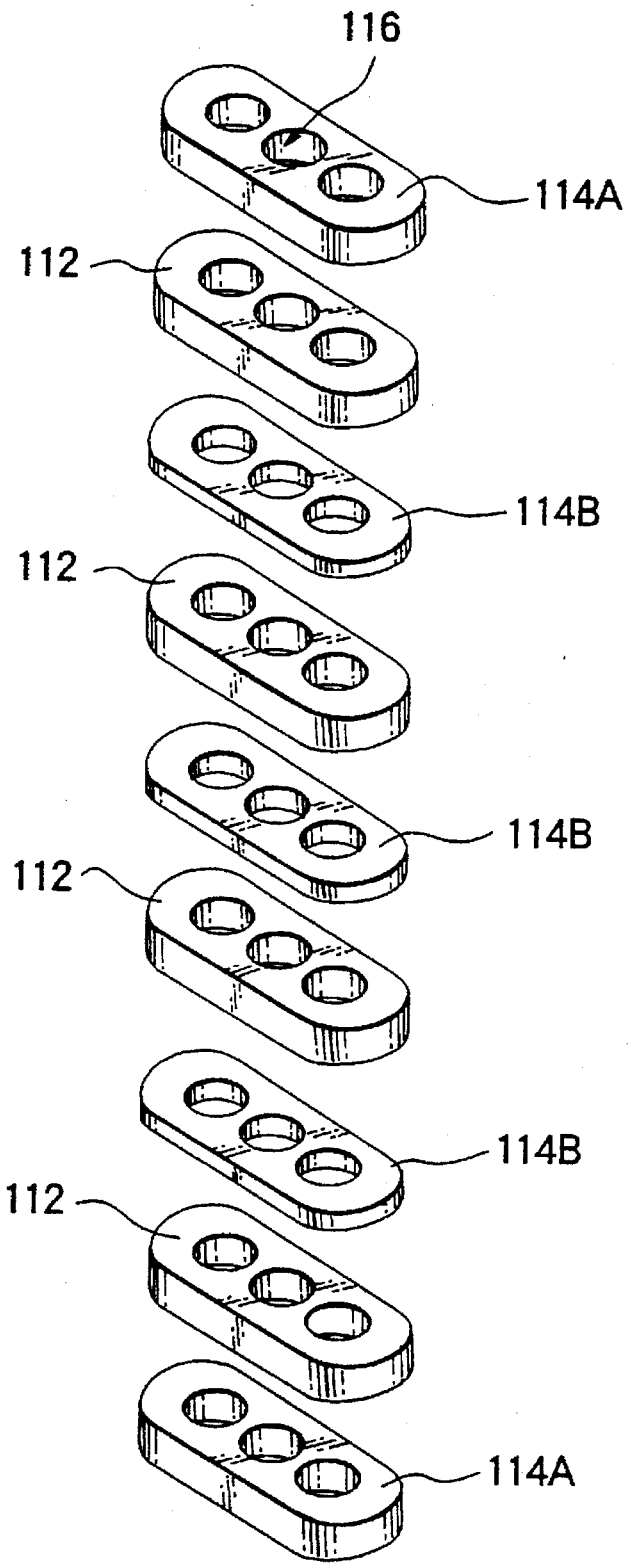
FIG. 2 is a schematic view of an arrangement of high electrical resistance materials and low electrical resistance materials just before lamination.

The main lens member 10 of the first embodiment, as shown in FIG. 2, can be fabricated by alternately superposing a high electrical resistance material 112 and low electrical resistance materials 114A and 114B controlled in volume resistivities and given desired shapes, then simultaneously sintering them to form a single unit. Further, three holes 116 for allowing passage of electron beams are formed in advance in these high electrical resistance materials 112 and low electrical resistance materials 114A and 114B. In some cases, further, each of the high electrical resistance material 112 and the low electrical resistance materials 114A and 114B may be comprised of one or more so-called green sheets.

In the first embodiment, the volume resistivity of the high electrical resistance layers 12 was made $10^{11}\Omega$.cm, while the volume resistivity of the low electrical resistance layers 14A and 14B was made $10^{7}\Omega$.cm. Further, the thickness of the high electrical resistance layers 12 in the tube axial direction was made 2 to 5 mm. On the other hand, the thickness of the low electrical resistance layers 14A at the two ends was made 2 to 4 mm, while the thickness of the low electrical resistance layers 14B sandwiched between high electrical resistance layers 12 was made about 0.5 mm. The outer dimensions of the main lens member 10 were about 20 mm×10 mm. The diameter of the beam passage holes 16 for allowing passage of electron beams, formed in the main lens member 10, was for example 5 mm.

By making the main lens member 10 such a construction, it is possible to make the resistance of the main lens member as a whole from the several tens of GΩ to several hundreds of GΩ considered necessary in the tube axial direction. The voltage drop at the low electrical resistance layers 14A and 14B is smaller by several orders (two to eight orders or so) than the voltage drop at the high electrical resistance layers 12, so it is possible to deem substantially the same potential to exist in one low electrical resistance layer 14A or 14B. Accordingly, it is possible to substantially ignore the variations in resistance of the low electrical resistance layers 14A and 14B.

The length of the high electrical resistance layers 12 in the tube axial direction is smaller compared with the size in the direction perpendicular to the tube axial direction. Further, each high electrical resistance layer 12 is sandwiched between low electrical resistance layers 14A and 14B. Accordingly, even if the resistance locally varies in the high electrical resistance layers 12, current flows parallel to the tube axis in the high electrical resistance layers 12. As a result, it is possible to form a distribution of potential with rotational symmetry about the tube axis. Further, even when the apparent resistance of the high electrical resistance layers 12 locally changes due to stray emission etc. during the operation of the electron gun, since each high electrical resistance layer 12 is sandwiched between low electrical resistance layers 14A and 14B, there is almost no disturbance of the rotational symmetry of the potential about the tube axis.

As explained above, even if the resistances of the high electrical resistance layer 12 and the low electrical resistance layers 14A and 14B vary, it is possible to form a distribution of potential rotationally symmetrical about the tube axis, so it is possible to form and maintain an excellent electron beam spot.

Further, by suitably adjusting the rate of shrinkage of the high electrical resistance material 112 and the low electrical resistance materials 114A and 114B at the time of sintering, it is possible to minimize the occurrence of deviation of the beam passage holes 16 for passing the electron beams and possible to maintain a degree of precision of assembly not posing a problem in the characteristics of the main lens. Further, even if deviation occurs in the beam passage holes 16, the inside surface of the beam passage holes 16 may be polished. This work is comparatively easy.

The boundary faces of the high electrical resistance layers 12 and the low electrical resistance layers 14A and 14B are formed by crystal grains of a particle size of not more than 10 μm or so, so there is no substantial problem with respect to the smoothness of the boundary faces.

Figure 3A:
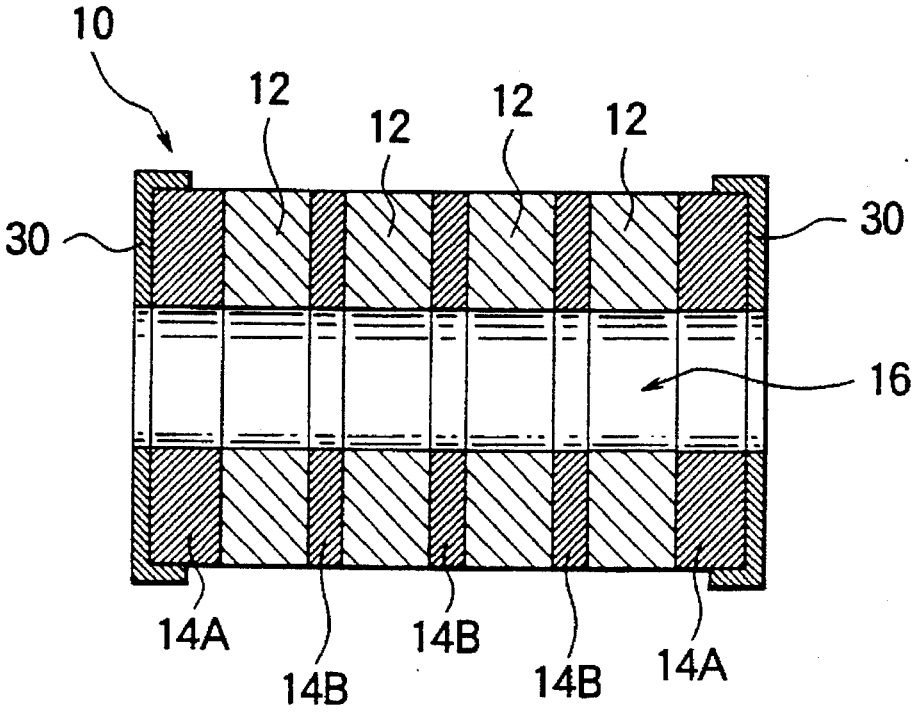
FIGS. 3A and 3B are a schematic view of a main lens member of a second embodiment and a perspective view of a mounting-use metal member.
Figure 3B:
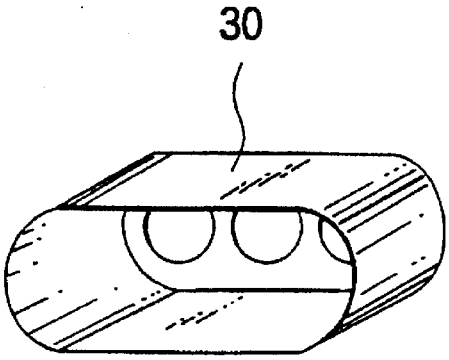

In a second embodiment, the main lens member of the first embodiment is provided with mounting-use metal members at the two ends. As shown by the schematic cross-sectional view of FIG. 3A, mounting-use metal members 30 comprised for example of stainless steel are shrink-fit to the two ends of the main lens member 10. The cross-sectional shape of the metal members 30 in the direction perpendicular to the tube axial direction is substantially the same as the cross-sectional shape of the main lens member in the direction perpendicular to the tube axial direction. Further, as shown by the schematic perspective view of FIG. 3B, each metal member 30 has a cap-like shape. That is, one end of the metal member 30 in the tube axial direction is provided with three holes for allowing the passage of electron beams, while the other end is open. The metal members 30 are heated to make them expand, the main lens member 10 is inserted from the open ends of the metal members 30, then the metal members 30 are cooled. In this way, it is possible to fabricate a main lens member with mounting-use metal members 30 shrink-fit at the two ends. The mounting-use metal members 30 are joined to other metal components of the electron gun (for example, the fifth grid and sixth grid) by, for example, the resistance welding method. Due to this, it is possible to fix in place the main lens member 10 and further possible to pass a current from one end to the other end of the main lens member 10 through the metal members 30.

Figure 4:
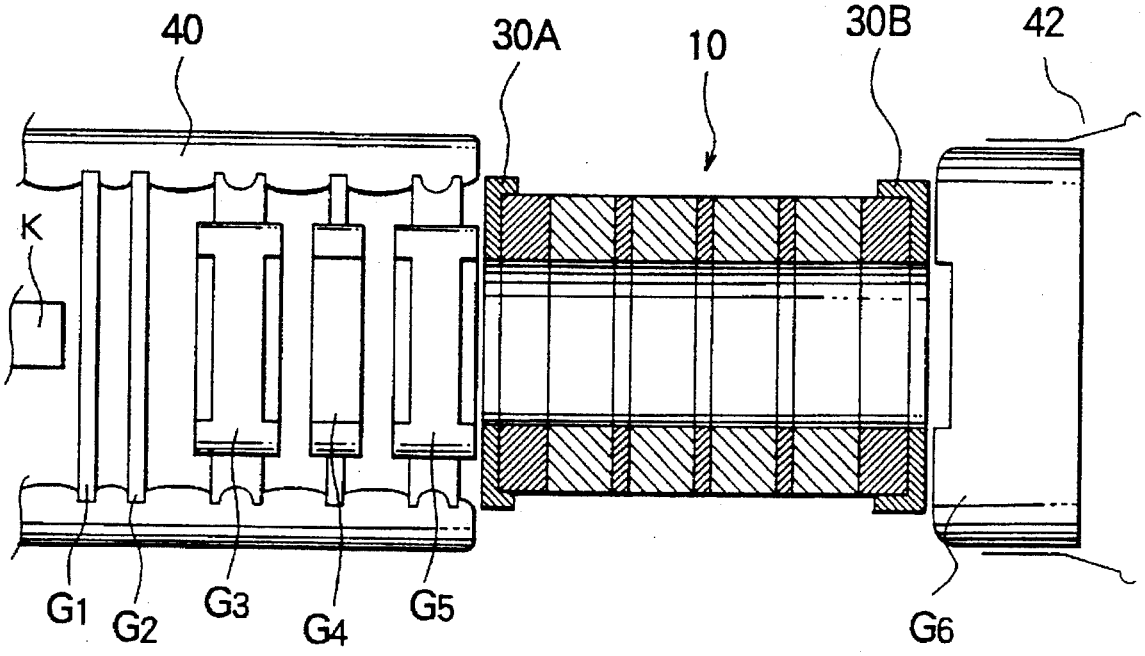
FIG. 4 is a schematic view of an electron gun of a third embodiment.

The third embodiment relates to an electron gun incorporating the main lens member explained in the second embodiment. As shown in FIG. 4, the electron gun of the third embodiment is comprised of a main lens member 10 with metal members 30A and 30B shrink-fit to the two ends, a cathode K, a metal first grid $G_1$, second grid $G_2$, third grid $G_3$, fourth grid $G_4$, and fifth grid $G_5$, a metal sixth grid $G_6$, and holding springs 42. The first grid $G_1$, second grid $G_2$, third grid $G_3$, fourth grid $G_4$, and fifth grid $G_5$ are beaded by the beading glass 40 to affix them to each other. One end of the holding springs 42 is attached to the sixth grid $G_6$. The other end of the holding springs 42 is made to contact the inner conductive film (not shown) formed at the inside surface of a cathode ray tube (not shown). The inner conductive film is connected to an anode button (not shown).

The pre-focus lens system is formed by the second grid $G_2$, third grid $G_3$, fourth grid $G_4$, and fifth grid $G_5$. The main lens system is formed by the fifth grid $G_5$ and the sixth grid $G_6$. The third grid $G_3$ and the fourth grid $G_4$ need not be provided. In the main lens system, a thick convex lens, several thin convex lenses, and a thick concave lens are formed from the fifth grid $G_5$ to the sixth grid $G_6$.

The mounting-use metal member 30A shrink-fit to one end of the main lens member 10 is welded to the fifth grid $G_5$. On the other hand, the mounting-use metal member 30B shrink-fit to the other end of the main lens member 10 is welded to the sixth grid $G_6$. Due to this, an intermediate (5 to 10 kV) voltage is applied from the fifth grid $G_5$ to the metal member 30A at the fifth grid $G_5$ side of the main lens member 10. On the other hand, an anode voltage (around 30 kV) is applied from the anode button, inner conductive film, holding springs 42, and sixth grid $G_6$ through the metal member 30B at the sixth grid $G_6$ side of the main lens member 10. Further, below, for convenience, the expression is used that "an anode voltage (around 30 kV) is applied from the sixth grid $G_6$ through the metal member 30B at the sixth grid $G_6$ side of the main lens member 10".

Figure 5A:
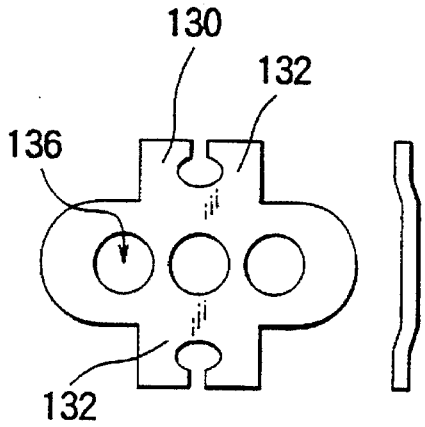
FIGS. 5A and 5B are a schematic view of a mounting-use metal member in a main lens member of a fourth embodiment and a schematic view of an electron gun provided with that main lens member.

In the second embodiment, mounting-use metal members 30 were shrink-fit at the two ends of the main lens member 10. As opposed to this, in the fourth embodiment, as shown by the schematic front view and side view of FIG. 5A, a mounting-use metal member 130 comprised of Inconel etc. and having a spring property is provided with a projection 132 for biting into the beading glass 40. Reference numeral 136 is a beam passage hole for passing an electron beam.

Figure 5B:
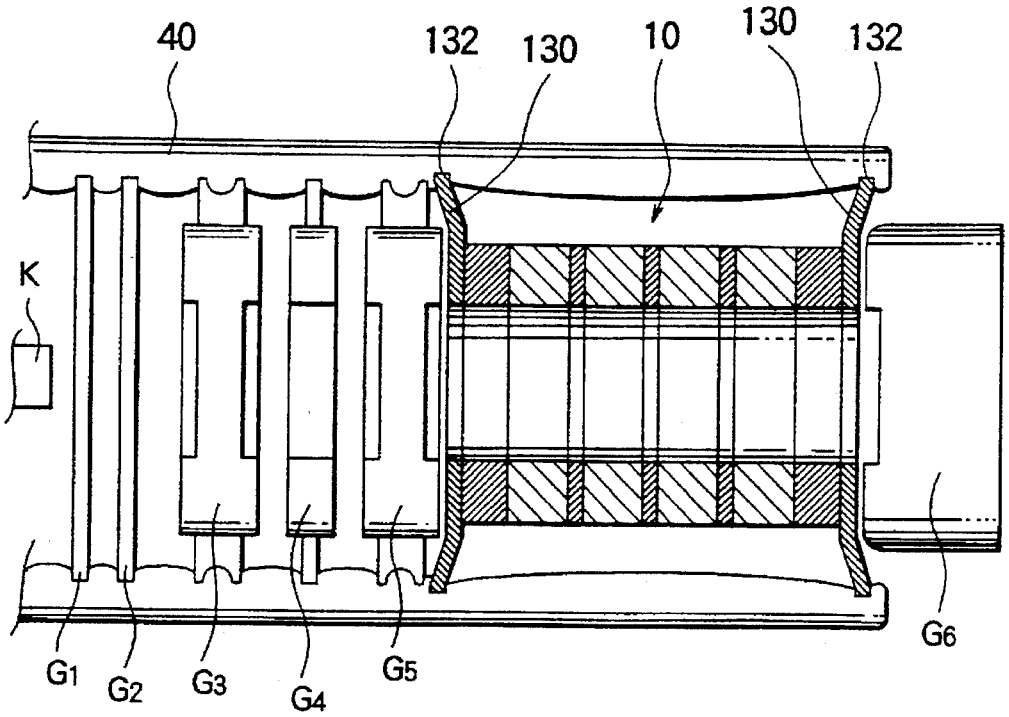

FIG. 5B shows the state with the main lens member 10 provided with the mounting-use metal members 130 incorporated into an electron gun. The main lens member 10 is sandwiched in by the metal members 130 provided with the projections 132 and is beaded by beading glass together with other electrodes in the state with a predetermined amount of pressure applied in the tube axial direction. Due to this, the first to fifth grids $G_1$ to $G_5$ and the main lens member 10 are affixed as a single unit. The mounting-use metal members 130 are fabricated from Inconel etc. having a spring property. Further, a contracting pressure is applied due to the beading glass. Therefore, the main lens member 10 is reliably affixed and the main lens member 10 and metal members 130 are brought into reliable contact. Due to this, an intermediate (5 to 10 kV) voltage is applied from the fifth grid $G_5$ to the metal member 130 at the fifth grid $G_5$ side of the main lens member 10. On the other hand, an anode voltage (around 30 kV) is applied from the sixth grid $G_6$ through the metal member 130 at the sixth grid $G_6$ side of the main lens member 10. Further, it is possible to provide unevenness on the metal members 130 to make the contact with the fifth and sixth grids $G_5$ and $G_6$ or the low electrical resistance layers 14A of the main lens member 10 more reliable. Alternatively, it is possible to provide convex portions at the surfaces of the fifth and sixth grids $G_5$ and $G_6$ coming in contact with the metal member 130. In FIG. 5B, the illustration of the holding springs is omitted.

Figure 6A:
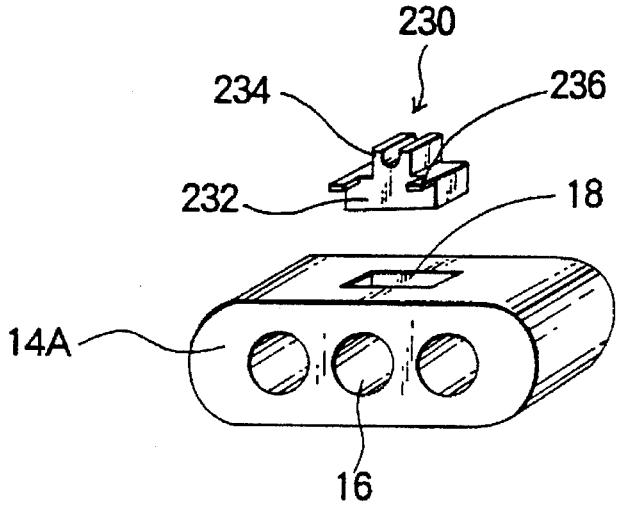
FIGS. 6A and 6B are views of part of the main lens member of a fifth embodiment and the state of the main lens member of the fifth embodiment incorporated in an electron gun.
Figure 6B:
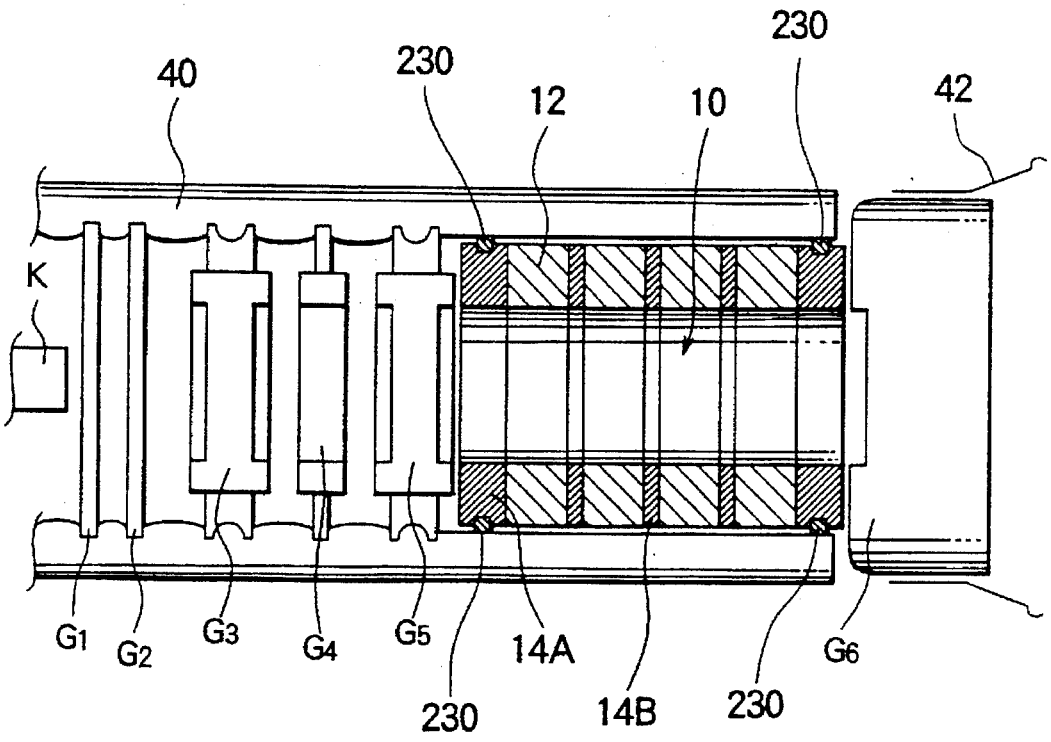

The fifth embodiment is a modification of the fourth embodiment. In the fifth embodiment, as shown in FIG. 6A, mounting-use metal members 230 are attached to (buried in) the low electrical resistance layers 14A at the two ends of the main lens member 10. More specifically, depressions 18 are formed in the low electrical resistance layers 14A of the two ends of the main lens member 10. The bottoms 232 of the mounting-use metal members 230 are inserted into the depressions 18. At the top surfaces of the metal members 230 there are formed projections 234 for biting into the beading glass 40. Further, projections 236 are provided at the metal members 230. The projections 236 have the function of stoppers when inserting the bottoms 232 of the mounting-use metal members 230 into the depressions 18 and the function of take-out portions for the leads for applying a voltage to the main lens member 10. The state of the main lens member of the fifth embodiment incorporated in an electron gun is shown in FIG. 6B.

Figure 7A:
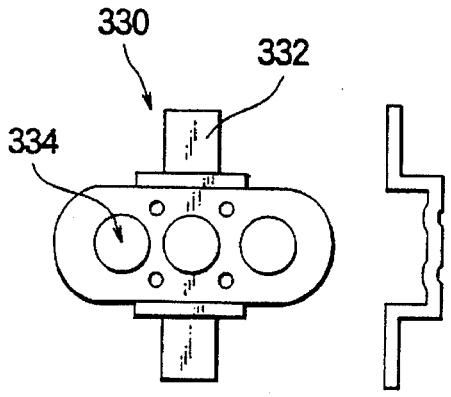
FIGS. 7A to 7C are views of part of the main lens member of a sixth embodiment and the state of the main lens member of the sixth embodiment incorporated in an electron gun.
Figure 7B:
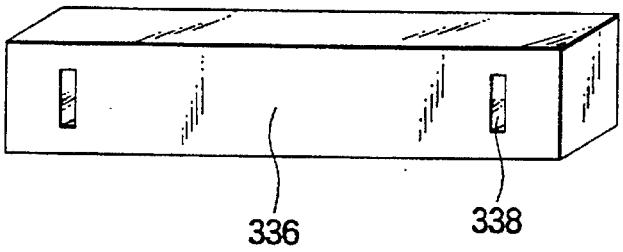

In the sixth embodiment, as shown by the schematic front view and side view of FIG. 7A, projections 332 are provided at mounting-use metal members 330 made of Inconel etc. By the engagement of the mounting holes 338 provided at the insulating member 336 with the projections 332, the metal members 330 come into reliable contact with the main lens member 10 and are reliably fixed to the main lens member 10. The insulating member 336 may for example be fabricated from a ceramic. A perspective view of the insulating member 336 having the mounting holes 338 as seen from the bottom is given in FIG. 7B.

Figure 7C:
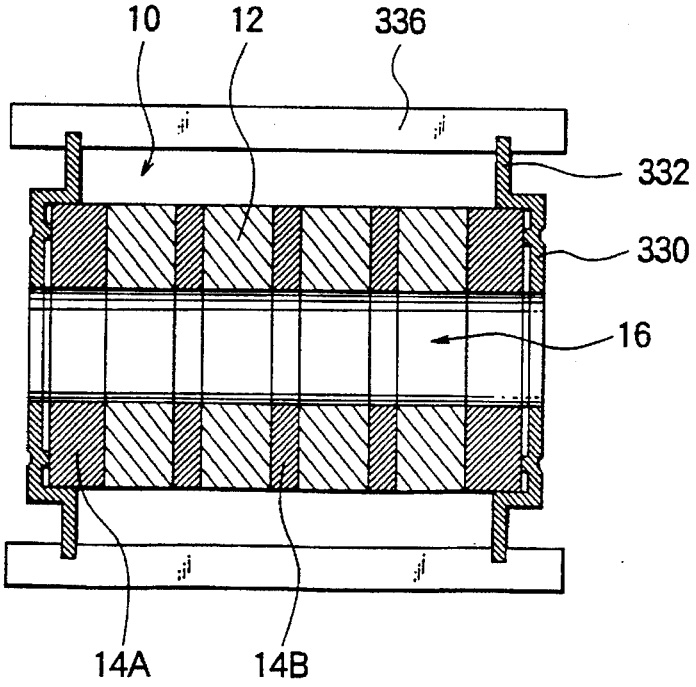

The assembled state of the main lens member 10, metal members 330, and insulating members 336 is shown in FIG. 7C. The mounting-use metal member 330 of one end of the main lens member 10 is welded to the fifth grid $G_5$. On the other hand, the mounting-use metal member 330 of the other end of the main lens member 10 is welded to the sixth grid $G_6$. Due to this, an intermediate (5 to 10 kV) voltage is applied from the fifth grid $G_5$ to the metal member 330 at the fifth grid $G_5$ side of the main lens member 10. On the other hand, an anode voltage (around 30 kV) is applied from the sixth grid $G_6$ through the metal member 330 at the sixth grid $G_6$ side of the main lens member 10.

Figure 8A:
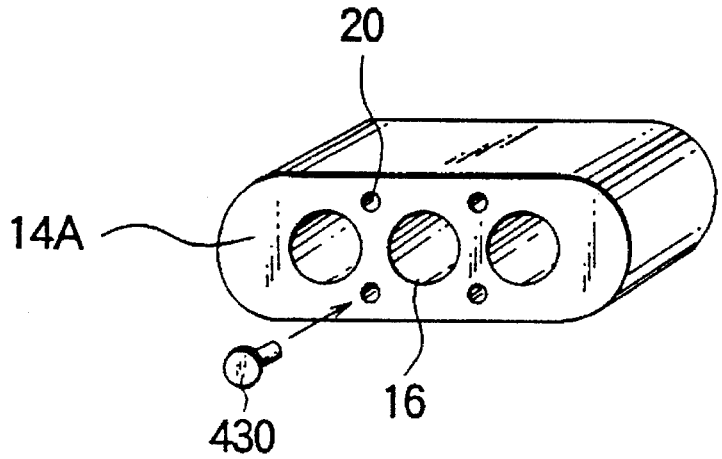
FIGS. 8A and 8B are views of part of the main lens member of a seventh embodiment and the state of the main lens member of the seventh embodiment incorporated in an electron gun.
Figure 8B:
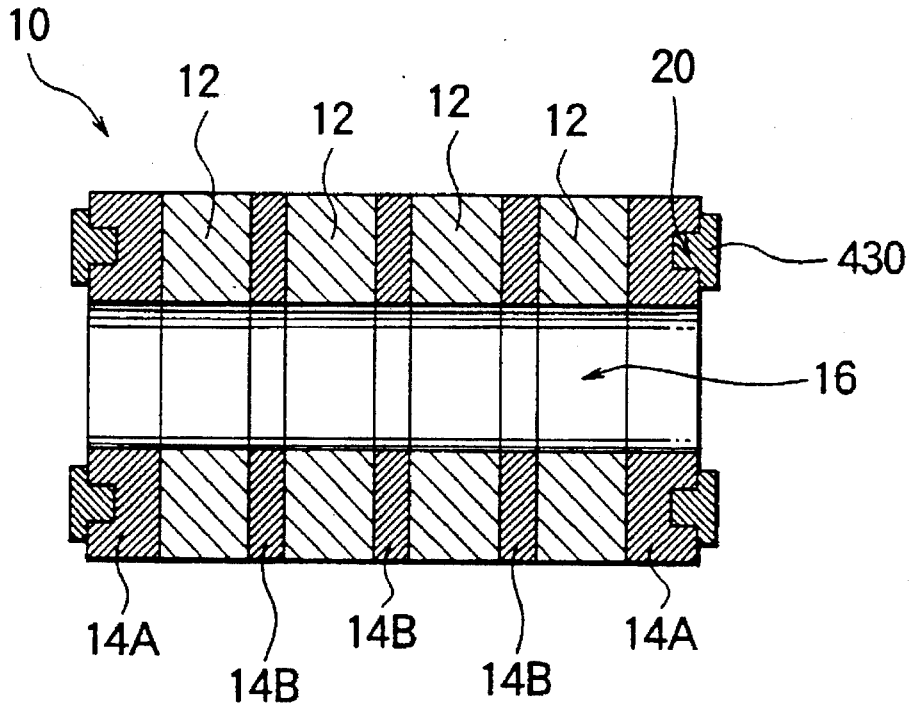

The main lens member 10 of the seventh embodiment is provided with metal members 430 buried in the low electrical resistance layers 14A at the two ends of the main lens member 10 as shown in FIG. 8B. The metal members 430 are for example comprised of rivets. The low electrical resistance layers 14A are for example formed with depressions 20 at four locations. The depressions 20 do not pass through the low electrical resistance layers 14A. When forming the depressions 20 as well, the low electrical resistance layers 14A and the high electrical resistance layers 12 are in complete contact, so the potential gradient in the high electrical resistance layers 12 is held parallel with the tube axis. Further, the metal members 430 are press-fit into the depressions 20. The voltage drop in the low electrical resistance layers 14A can be ignored, so even if there are the metal members 430, the disturbance to the electric field can be ignored.

The mounting-use metal member 430 of one end of the main lens member 10 is welded to the fifth grid $G_5$. The mounting-use metal member 430 of the other end of the main lens member is welded to the sixth grid $G_6$. Due to this, an intermediate (5 to 10 kV) voltage is applied from the fifth grid $G_5$ through the metal member 430 at the fifth grid $G_5$ side of the main lens member 10. On the other hand, an anode voltage (around 30 kV) is applied from the sixth grid $G_6$ through the metal member 430 at the sixth grid $G_6$ side of the main lens member 10. The metal members 430 are not limited to rivets and may take any shape or form.

Figure 9:
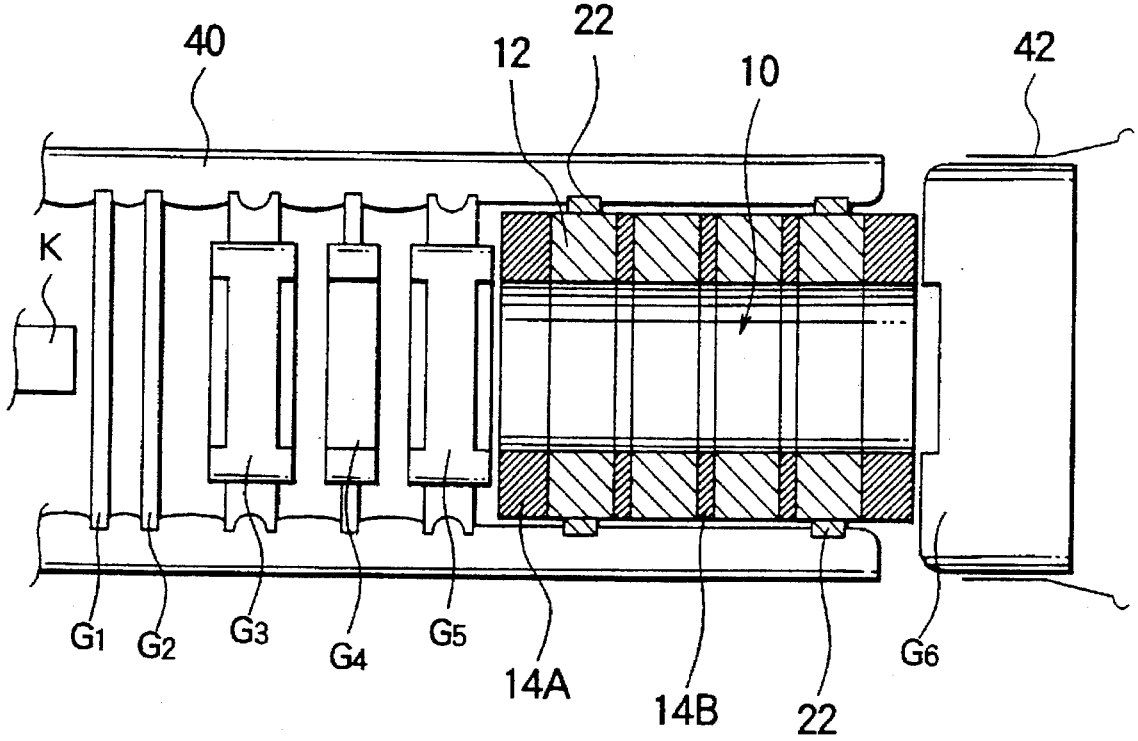
FIG. 9 is a schematic view of the state of a main lens member of an eighth embodiment incorporated in an electron gun.

The state of the main lens member of an eighth embodiment incorporated in an electron gun is shown in FIG. 9. In the main lens member of the eighth embodiment, the high electrical resistance layers 12 are formed with projections 22 for beading by the beading glass 40. The projections 22 may be formed by coating and curing a ceramic adhesive on the outer surface of a main lens member fabricated as a single unit by sintering. Alternatively, the projections may be formed by providing them on them on the high electrical resistance material when shaping the high electrical resistance material.

The projections 22 provided on the high electrical resistance layers 12 are brought into contact with the beading glass 40, and the first grid $G_1$, second grid $G_2$, third grid $G_3$, fourth grid $G_4$, and fifth grid $G_5$ are beaded by the beading glass 40 so as to affix the first to fifth grids $G_1$ to $G_5$ and the main lens member 10 as a single unit.

The projections 22 may be provided on the low electrical resistance layers 14A and 14B as well. Further, to ensure a reliable electrical connection between the main lens member 10 and the fifth grid $G_5$ and sixth grid $G_6$, metal members 30 explained with reference to the second embodiment may be shrink-fit to the two ends of the main lens member 10 or the metal members 230 explained with reference to the fifth embodiment or the metal members 430 explained with reference to the seventh embodiment may be buried in the low electrical resistance layers 14A at the two ends of the main lens member 10.

Figure 10A:
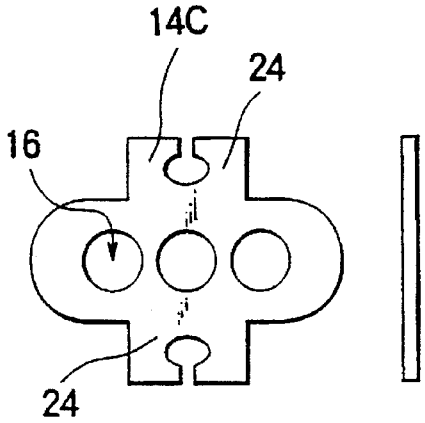
FIGS. 10A and 10B are views of part of the main lens member of a ninth embodiment and the state of the main lens member of the ninth embodiment incorporated in an electron gun.
Figure 10B:
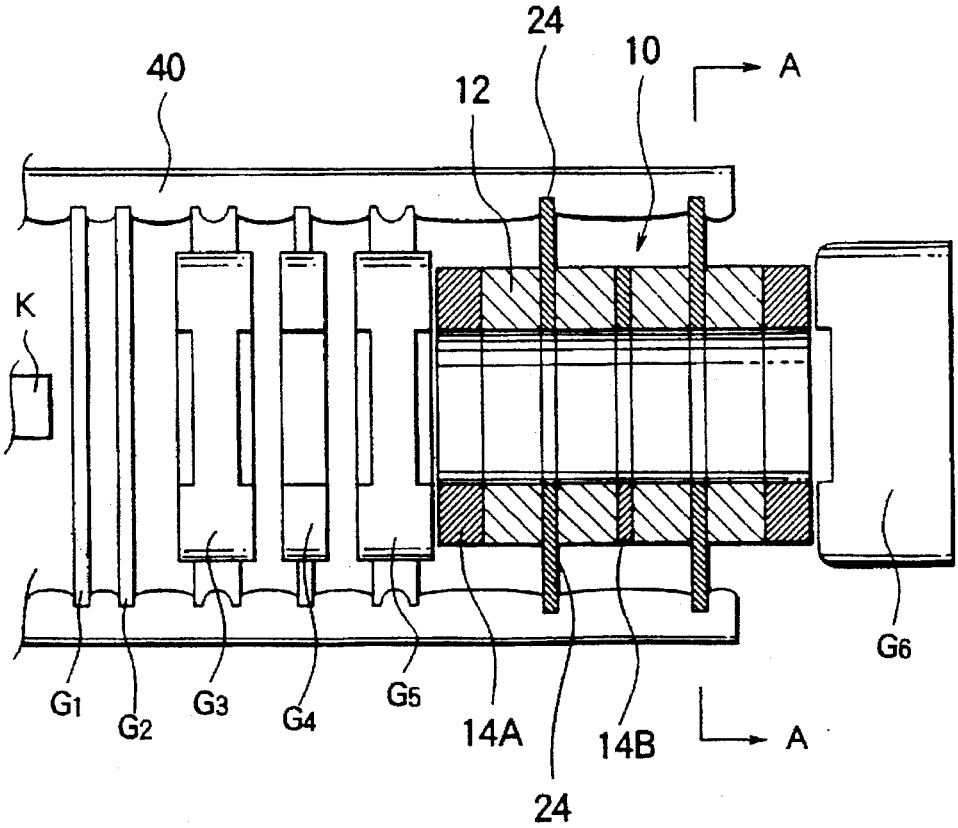

The ninth embodiment is a modification of the eighth embodiment. The state of the main lens member of the ninth embodiment incorporated in an electron gun is shown by the schematic cross-sectional view of FIG. 10B. As shown in FIG. 10B, the low electrical resistance layers 14C are formed with projections 24 for beading by the beading glass 40. The projections 24 may by formed by providing the projections on the low electrical resistance material at the time of shaping the low electrical resistance material. Further, FIG. 10A is a view along the line A—A of FIG. 10B and illustrates just the low electrical resistance layer 14C by a schematic front view and side view.

The low electrical resistance layers 14C, the first grid $G_1$, the second grid $G_2$, the third grid $G_3$, the fourth grid $G_4$, and the fifth grid $G_5$ are beaded by the beading glass 40 so as to affix the first to fifth grids $G_1$ to $G_5$ and the main lens member 10 as a single unit.

The projections 24 may also be provided at the high electrical resistance layers 12. Further, to ensure a reliable electrical connection between the main lens member 10 and the fifth grid $G_5$ and sixth grid $G_6$, metal members 30 explained with reference to the second embodiment may be shrink-fit to the two ends of the main lens member 10 or the metal members 230 explained with reference to the fifth embodiment or the metal members 430 explained with reference to the seventh embodiment may be buried in the low electrical resistance layers 14A at the two ends of the main lens member 10.

In the first to ninth embodiments, use was made of a material comprising a ceramic as its main ingredient for the high electrical resistance material and the low electrical resistance material constituting the main lens member. As opposed to this, in a 10th embodiment, the high electrical resistance material comprising the main lens member is made a ceramic as its main ingredient and the low electrical resistance material is comprised of a ruthenium oxide type material. As the ruthenium oxide type material, mention may be made of a mixture of ruthenium oxide ($RuO_2$) and a glass paste. Further, to control the electrical properties, Ag, $Nb_2O_5$, $Bi_2O_3$, Rh, or Ir may be added. Alternatively, as the ruthenium oxide type material, mention may be made of a mixture of a composite oxide such as $M_2Ru_2O_{7-x}$ and a glass paste. Here, M may be Bi, Pb, Ba, etc.

Figure 11:
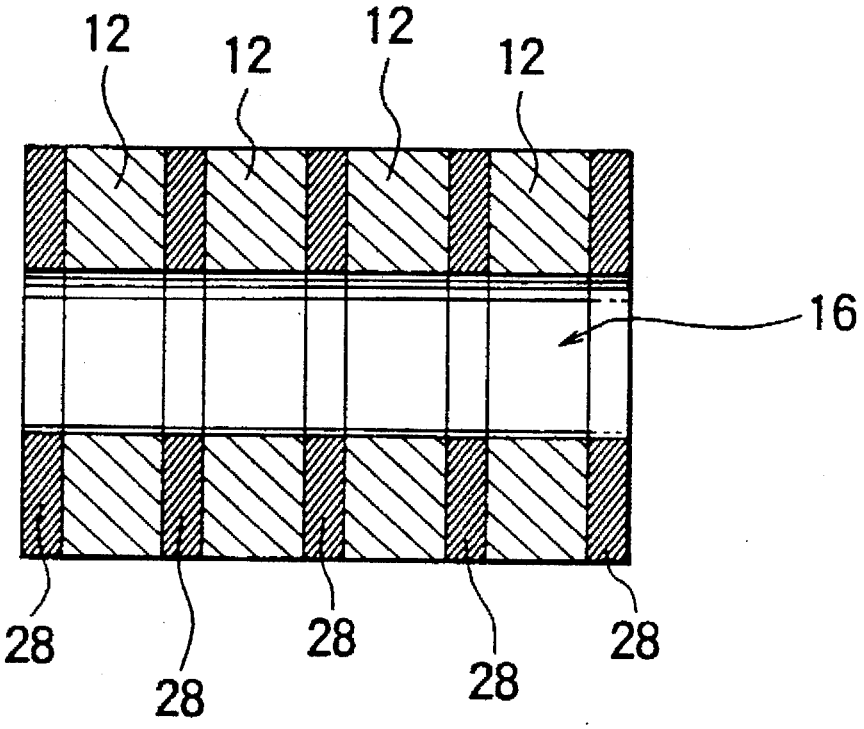
FIG. 11 is a schematic cross-sectional view of a main lens member of a 10th embodiment.

The high electrical resistance material 112 shown schematically in FIG. 2 is sintered alone to fabricate the high electrical resistance layers, then the surfaces are coated by, for example, the screen printing method, with for example a ruthenium oxide type material comprising ruthenium oxide and glass paste, then the surfaces are dried to remove the solvent in the ruthenium oxide type material. A plurality of the high electrical resistance layers are superposed and the ruthenium oxide type material is sintered to form a single unit, whereby it is possible to fabricate the main lens member of the 10th embodiment of the schematic cross-section shown in FIG. 11. Reference numeral 12 is a high electrical resistance layer, 28 a low electrical resistance layer comprised of the ruthenium oxide type material, and 16 a beam passage hole. The thus fabricated main lens member may be assembled into an electron gun by making suitable use of various means as explained in the second embodiment and the fourth to ninth embodiments.

In addition to a ruthenium oxide type material, it is also possible to use as the low electrical resistance material a Pd—Ag type, $T1_2O_3$ type, $MoO_3$ type, $LaB_6$ type, or other type of material.

The present invention was explained above with reference to preferred embodiments, but is not limited to these embodiments in any way. The figures, shapes, and materials explained in the embodiments were illustrative and can be suitably changed. In the embodiments, further, the number of high electrical resistance layers was made four, but may be any number. Also, the main lens member of the present invention may be applied not only to an in-line gun configuration, but also to a delta-gun configuration, an in-line gun, or a single electron gun of a projector tube, index tube, monochrome tube, etc. The main lens system is also not limited to a bi-potential focus system or uni-potential focus system and may be applied to other various types of main lens systems. The low electrical resistance layer made of the low electrical resistance material comprised of a ceramic as the main ingredient and the low electrical resistance layer made of a ruthenium oxide type material may also be mixed in a single main lens member. The resistances (or volume resistivities) of the individual layers of the high electrical resistance layers or low electrical resistance layers may be the same or different depending on the design specifications of the main lens system. Further, the resistance (or volume resistivity) may be changed in the tube axial direction in the individual high electrical resistance layers or low electrical resistance layers. The two ends of the main lens member may be formed from the high electrical resistance layers.

Figure 12A:
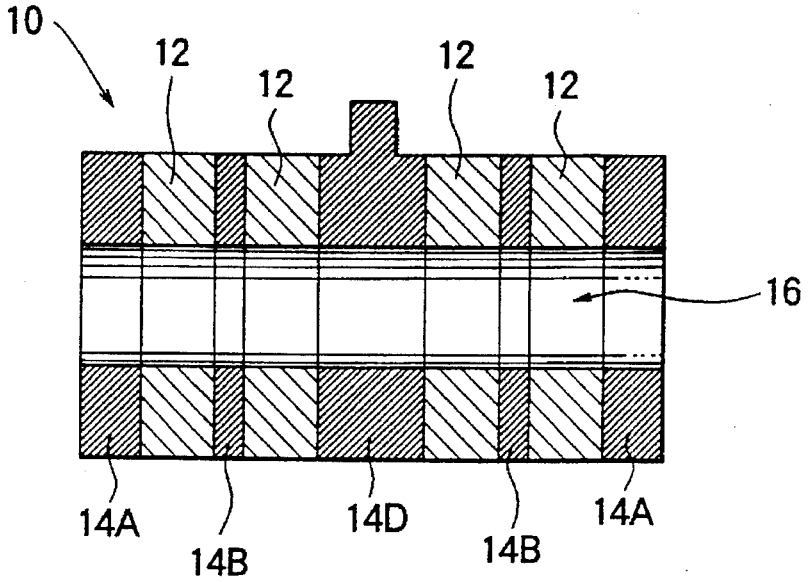
FIGS. 12A and 12B are schematic views of the state of a main lens member of the present invention, suitable for use in a main lens system of a uni-potential focus type, incorporated in an electron gun.
Figure 12B:
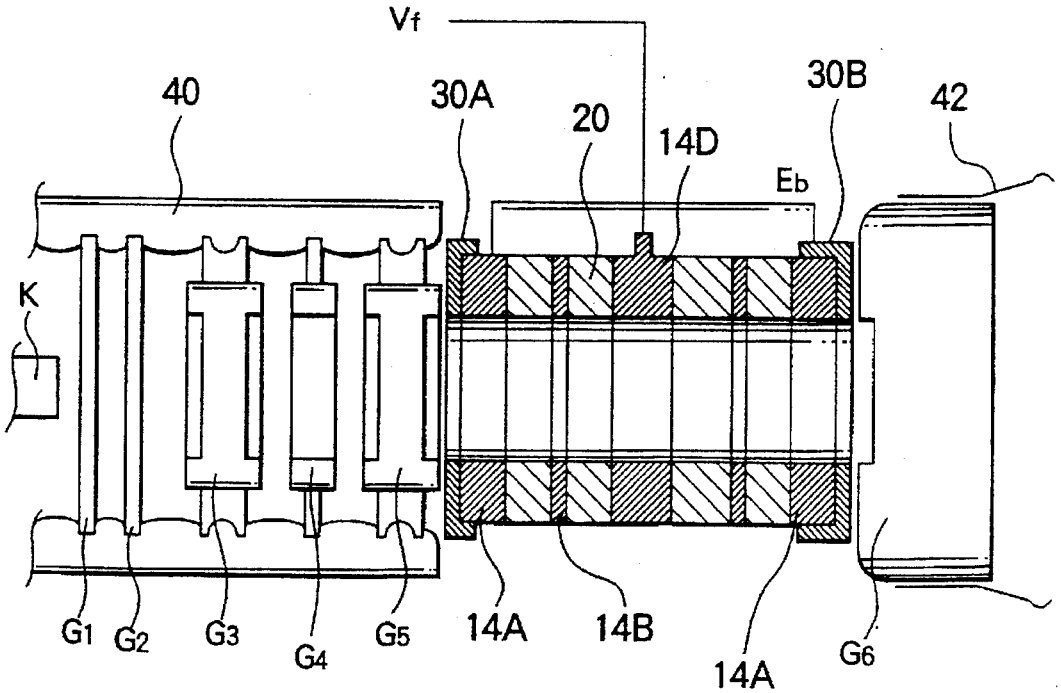

In the embodiments, the explanation was made of a main lens member suited for use solely in a main lens system of a bi-potential focus system, but the main lens member of the present invention can also be used in a main lens system of a uni-potential focus system, for example. In this case, as shown by the schematic cross-sectional view of FIG. 12B, a lead is connected to the low electrical resistance layer 14D and a focus voltage (0 to 10 kV) is applied to the low electrical resistance layer 14D. On the other hand, an anode voltage is applied to the fifth grid $G_5$ and the sixth grid $G_6$. The lead may be led out by any method. For example, it is possible to make use of the metal member 230 explained with reference to the fifth embodiment or, in the same way as explained with reference to the ninth embodiment, provide a projection at the low electrical resistance layer 14D, cover this projection with a metal cap, and connect a lead to this metal cap, etc. Further, it is possible to replace the low electrical resistance layer 14D with for example a metal electrode.

The main lens member of the present invention is easy to fabricate yet can be fabricated with a high precision. Accordingly, it is possible to suppress the deviation of concentricity of the main lens member and reduce the off-axis angle of the electron beam. Further, even if the resistance of the high electrical resistance layer or low electrical resistance layer varies, it is possible to form a distribution of potential with rotational symmetry about the tube axis. That is, it is possible to form a uniform electric field in the main lens system. Still further, even if the apparent resistance of the high electrical resistance layer locally changes due to stray emission etc. during the operation of the electron gun, there is almost no disturbance of the rotational symmetry of the potential about the tube axis. As a result, it is possible to form and maintain an excellent electron beam spot. Also, it is possible to prevent electric discharge in the main lens member. Further, it is possible to reduce the spherical aberration of the main lens system, so it is possible to obtain an excellent beam spot.

By shortening the length of the high electrical resistance layer in the tube axial direction and constituting the main lens member from a large number of high electrical resistance layers, it is possible to improve the dimensional precision of the individual electrical resistance layers (in particular the dimensional precision of the inner diameter of the beam passage holes) after simultaneous sintering in a high electrical resistance material and low electrical resistance material comprised of ceramic as a main ingredient and possible to obtain a high dimensional precision for the main lens member as a whole.

Further, by providing the main lens member with mounting-use metal members or providing the high electrical resistance layers or low electrical resistance layers with projections, it is possible to easily assemble the main lens member in an electron gun.

What is claim is:

1. A main lens member for converging an electron beam in an electron gun, comprising at least one high electrical resistance layer made of a high electrical resistance material, and at least one low electrical resistance layer made of a low electrical resistance material, said high electrical resistance layer and said low resistance layer being integrally laminated together.

2. A main lens member for an electron gun as set forth in claim 1, comprising N number of high electrical resistance layers and (N+1) number of low electrical resistance layers laminated together.

3. A main lens member for an electron gun as set forth in claim 2, wherein said high electrical resistance material and said low electrical resistance material are comprised of a ceramic material.

4. A main lens member for an electron gun as set forth in claim 3, wherein said high resistance layer of a high electrical resistance material and said low resistance layer of a low electrical resistance material are alternately superimposed and simultaneously sintered to form a single unit.

5. A main lens member for an electron gun as set forth in claim 2, wherein said high electrical resistance material is comprised of a ceramic as a main ingredient and said low electrical resistance material is comprised of a ruthenium oxide material.

6. A main lens member for an electron gun as set forth in claim 1, further comprising mounting-use metal members at two ends of the main lens member.

7. A main lens member for an electron gun as set forth in claim 6, wherein said mounting-use metal members are shrink-fit to the two ends of the main lens member.

8. A main lens member for an electron gun as set forth in claim 6, wherein said mounting-use metal members have projections for attaching beading glass.

9. A main lens member for an electron gun as set forth in claim 6, wherein said mounting-use metal members have projections for affixment to an insulating member having mounting holes.

10. A main lens member for an electron gun as set forth in claim 1, comprising metal members buried in said main lens member.

11. A main lens member for an electron gun as set forth in claim 1, wherein said high electrical resistance layers or said low electrical resistance layers have projections for beading with beading glass.

12. An electron gun provided with a main lens member comprising of at least one high electrical resistance layer made of a high electrical resistance material and at least one low electrical resistance layer made of a low electrical resistance material laminated together.

13. A main lens member for an electron gun comprising:

first and second end layers comprised of a low resistance material;

at least two layers of high resistance material formed between the end layers and wherein the high resistance material layers are separated by at least one further low resistance material layer.

14. The main lens member of claim 13, wherein the end low resistance material layers are wider than the further low resistance material layer.

15. The main lens member of claim 13, further comprising at least three high resistance material layers.

16. The main lens member of claim 13, wherein the high and low resistance layers further comprise a plurality of holes located therein which are perpendicular to a direction of lamination.

* * * * *